United States Patent [19]

Knape et al.

[11] 4,065,058

[45] Dec. 27, 1977

[54] FUEL INJECTION NOZZLE WITH COMPRESSIBLE VALVE

[75] Inventors: Richard S. Knape; Joseph Lukas, both of Grand Rapids, Mich.

[73] Assignee: General Motors Corporation, Detroit, Mich.

[21] Appl. No.: 688,694

[22] Filed: May 21, 1976

[51] Int. Cl.[2] ..... B05B 1/30

[52] U.S. Cl. ..... 239/88; 239/533.9; 137/510

[58] Field of Search ..... 239/533.1–533.15, 239/452, 88; 137/510; 251/61

[56] References Cited

U.S. PATENT DOCUMENTS

| | | | |
|---|---|---|---|
| 1,457,701 | 6/1923 | Hesselman | 239/533.8 |
| 1,498,034 | 6/1924 | Hesselman | 239/533.8 |
| 1,525,156 | 2/1925 | Teufl | 239/533.8 |
| 3,075,707 | 1/1963 | Rademaker | 239/533.8 |
| 3,115,304 | 12/1963 | Humphries | 239/533.8 |

*Primary Examiner*—John J. Love
*Attorney, Agent, or Firm*—Arthur N. Krein

[57] ABSTRACT

A fuel injection nozzle assembly includes a nozzle body and a compressible valve therein having a valve head that is normally in loaded abutment against a valve seat in the nozzle body to block the discharge of fuel therefrom, the compressible valve further including a stem extending from the valve head which is fixed at its opposite end to the valve body, the stem including a thin wall, tubular compressible stem portion next adjacent to the valve head and connected thereto by an annular shoulder, the compressible stem portion having an outside diameter substantially greater than the diameter of the valve head with the thin wall of the compressible stem portion being sized so that when fuel, in an annular fuel chamber in the nozzle body encircling the compressible stem portion, at a high fuel pressure acts on the annular shoulder, it will cause a reduction in the normal longitudinal extent of the compressible valve to effect unseating of the valve head from the valve seat and, when the fuel in the fuel chamber is at a reduced pressure, the valve head is seated against the valve seat.

5 Claims, 2 Drawing Figures

FUEL INJECTION NOZZLE WITH COMPRESSIBLE VALVE

Figure 1:
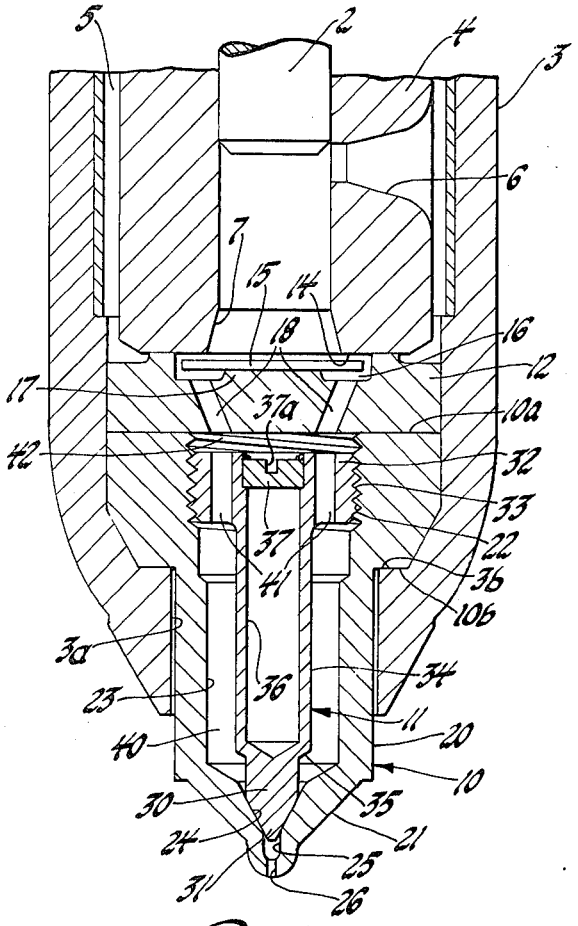

This invention relates to a device for injecting fuel into the cylinders of an internal combustion engine and, in particular, to a fuel injector nozzle assembly with compressible valve for such a device.

Fuel injectors or fuel injection nozzles, whether used as part of a unit fuel injector or as part of a pump and nozzle system, are normally of the needle valve controlled type that includes a nozzle body having a spray tip at one end thereof with spray orifices therein in communication with an axial passage in the nozzle body supplied with fuel under pressure, flow of fuel through the passage to the spray orifices being controlled by a needle valve having a seat at one end thereof adapted to cooperate with a seat in the nozzle body upstream of the spray orifices, the needle valve being normally biased to a closed position by a closing spring.

In addition, in these prior art needle valve type injectors or nozzles, the force of the closing spring must be sufficient to effect seating of the needle valve against cylinder pressure which acts to hold the needle valve open.

It is therefore a primary object of this invention to provide an improved fuel injection nozzle whereby fuel delivery therefrom is controlled by a normally seated valve that is axially compressible, as a function of a predetermined fuel pressure within a fuel chamber in the nozzle body acting thereon whereby to effect unseating of the normally seated head of the valve from its valve seat in the nozzle body.

Another object of this invention is to provide an improved fuel injector nozzle assembly including a nozzle body and a valve wherein the valve is compressed relative to the nozzle body to effect a temporary reduction of its longitudinal length so as to cause opening of the valve relative to a valve seat in the nozzle body.

A further object of this invention is to provide an improved fuel injector nozzle assembly wherein the conventional valve actuating spring, normally used in such an assembly, has been eliminated.

A still further object of this invention is to provide an improved fuel injector nozzle which is of simple construction and which can easily and economically manufactured.

These and other objects of the invention are obtained in a fuel injection nozzle assembly including a nozzle body and compressible valve therin, wherein the nozzle body, having a spray tip at one end thereof with a fuel discharge passage therethrough, is provided with an enlarged bore extending from its opposite end to the fuel discharge passage and forming in the nozzle body an annular valve seat, the compressible valve being positioned in the enlarged bore in the nozzle body so that its reduced diameter valve head at one end thereof is normally seated against the valve seat to close off the fuel discharge passage, the compressible valve having a large diameter valve stem extending from the valve head to provide therewith an annular shoulder, the valve stem including a thin wall, tubular, compressible stem portion extending from the annular shoulder to a rigid stem portion at the opposite end of the valve stem from the valve head, the rigid stem portion being axially fixed to the opposite end of the nozzle body from the spray tip, the compressible stem portion and at least a portion of the valve head forming with the bore in the nozzle body an annular fuel chamber, passage means being provided to be in communication at one end with the annular fuel chamber and connectable at its opposite end to a source of fuel, the compressible stem portion having a predetermined wall thickness whereby fuel, at a predetermined high pressure in the annular fuel chamber, will effect longitudinal deformation of this compressible stem portion to effect a limited longitudinal decrease in length of the valve without permanent deformation whereby the valve head is caused to unseat from the valve seat to permit discharge of fuel through the fuel discharge passage and, when the pressure of fuel in the fuel chamber decreases to a predetermined pressure, the valve stem will resume its original length to effect seating of the valve head against the valve seat.

Figure 2:
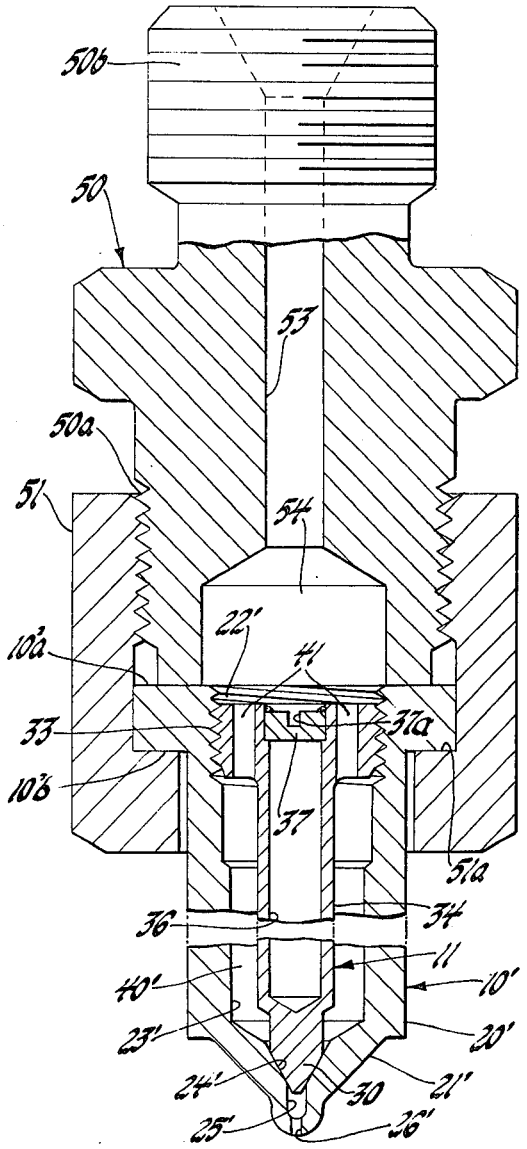

For a better understanding of the invention, as well as other objects and further features thereof, reference is had to the following detailed description of the invention to be read in connection with the accompanying drawings, wherein:

FIG. 1 is a longitudinal, sectional view through a portion of a unit type fuel injector having a fuel injection nozzle with compressible valve, in accordance with the invention, incorporated therein; and, FIG. 2 is an elevational view, with parts in section, of a fuel injection nozzle assembly having a fuel injection nozzle with compressible valve, similar to that in the unit fuel injector of FIG. 1, incorporated therein.

Referring first to FIG. 1, there is shown the fuel injection nozzle with compressible valve of the invention used in an otherwise conventional unit fuel injector, only the lower portion of which is shown. As is well known, the upper portion of such a conventional unit fuel injector would include a housing, not shown, in which a pump plunger 2 is reciprocally mounted. Forming an extension of and threaded to the lower end of the housing is a sleeve nut 3 within which is supported a bushing 4 in abutment against the lower end of the housing, the bushing forming the pump cylinder of the plunger 2. An annular space or fuel chamber 5 surrounding the bushing 4 within the nut 3 is supplied with fuel at a relatively low supply pressure via passage means, not shown, in the housing from an external fuel inlet in a well-known manner, the fuel chamber 5 also being in communication with a fuel return outlet connection, not shown, also in a well-known manner.

The plunger 2 has the usual central passage, not shown, at the lower end thereof and the usual external metering groove helix, also not shown, adjacent to its lower end by which opening and closing of the lower port 6 and an upper port, not shown, in the bushing 4 are controlled during each downward stroke of the plunger 2 to deliver a predetermined volume of fuel through the lower open end 7 of the bushing 4 for injection into the cylinder of an engine, not shown, via the fuel injector nozzle assembly of the invention, to be described, that is supported in the bottom of this unit injector.

Other details of the upper or pump part of the unit injector are not important to an understanding of the present invention and are common to conventional constructions of unit type fuel injectors, for example, a unit fuel pump-injector of the type as shown and described in such prior patents as U.S. Pat. No. 2,951,643 entitled "Fuel Injector with Pilot Injection" issued Sept. 6, 1960 to Royce G. Engle, Jr. and U.S. Pat. No. 2,898,051 entitled "Fluid Injection Device" issued Aug. 4, 1959 to Conrad A. Teichert. Accordingly, a detailed description of the upper portion of the unit fuel pump-injector is not deemed necessary, especially since it forms no part of the subject invention.

The nut 3, in the form of a sleeve nut, has an opening 3*a* at its lower end to slidably receive the lower end of the fuel injection nozzle with compressible valve of the invention, this fuel injection nozzle with compressible valve including a nozzle body 10 with a compressible valve 11 positioned therein. In addition, a valve seat disk 12 is sandwiched between the upper or inlet end 10*a* of the nozzle body 10 and the bottom of the bushing 4, the nozzle body 10 having an annular shoulder 10*b* thereon which seats on a shoulder 3*b* provided by the through counterbore in the nut 3.

The lower end face 14 of the bushing 3 serves as a closure seat for a circular check valve disk 15. This check valve disk 15 is disposed in a cavity 16 formed in the upper end of the valve seat disk 12, the sides of the cavity 16 extending laterally beyond the lateral extremities of the open end 7 of the pump cylinder and serves to loosely guide the check valve disk 15. A central protuberance 17 is formed in the bottom of the cavity 16 and serves to limit opening travel of the check valve disk 15. The cavity 16 also forms the upper end of fuel passage means connecting the open end 7 of the pump cylinder to the inlet end of the nozzle body 10, this passage means including one or more axial extending passages 18 through the valve seat disk 12.

Referring now to the subject matter of the invention, the nozzle body 10, in the construction illustrated, of the subject injection nozzle with compressible valve assembly includes a large diameter upper cylindrical inlet end 10*a* with an intermediate portion 20 of reduced outside diameter depending therefrom which terminates in a spray tip 21. Nozzle body 10 is formed with an internally threaded bore 22 through its upper or inlet end 10*a* which is aligned with a bore cavity providing an inner peripheral wall 23 in the intermediate portion 20 and, the spray tip 21 portion of the nozzle body is formed with a conical valve seat 24 connected to the wall 23 and formed concentric with a fuel discharge passage means in the spray tip 21, which, in the construction illustrated, includes a bore passage 25 extending from valve seat 24 to communicate with one or more spray tip openings or discharge orifices 26 through the free end of the spray tip, only one such discharge orifice 26 being shown in the construction illustrated. The valve seat 24 partly closes one end, the lower end as shown, of the bore cavity in the nozzle body.

The compressible valve 11, made of suitable material as described hereinafter, includes a head 30 with a stem extending therefrom. The free end surface 31 of the valve head 30 is of a size and conical shape whereby it can abut against the valve seat 24 when the valve head is in its closed position relative thereto so as to block fluid flow between the bore cavity in the nozzle body and the fuel discharge passage means in its spray tip. The stem of the valve 11, in the construction illustrated, and starting at its so-called free end includes an enlarged stem end 32 having external threads 33 thereon for threaded engagement with the internal threads 22 in the nozzle body, and a thin wall tubular compressible stem portion 34 extending therefrom to the valve head 30 that is of a larger predetermined external diameter than the valve head 30 to provide therewith an annular shoulder 35 which, as will become apparent, in effect, connects the valve head 30 to the compressible stem portion 34. In the construction illustrated, the interior wall of the compressible stem portion 34 is provided by a straight stepped bore 36 extending from the enlarged stem end 32 through the compressible stem portion 34 to the shoulder 35. A plug 37 is positioned in the bore 36 and fixed to the wall provided by the bore, as by welding, to block off the end of the passage provided by the bore 36 in the enlarged stem end. In addition, suitable means, such as the slot 37*a* for a screwdriver in plug 37 fixed to the valve 11, is provided on the valve whereby it is threadably torqued down in the nozzle body 10 so that its valve head 30 can be seated in loaded abutment against the valve seat 24.

In the assembled position of the valve 11 into the bore of the nozzle body 10, the valve head 30 thereof is positioned in loaded abutment against the valve seat 24, its enlarged stem end 32 is fixed to the inlet end 10*a* of the nozzle body 10 and the portion therebetween forms with the inner peripheral wall 23 of the nozzle body an annular fuel chamber 40 which is, at one end, in fluid communication with the fuel discharge passage means in the spray tip 21 as controlled by the valve 11. At its opposite end, the fuel chamber 40 is suitably connected to the source of fuel as supplied through passages 18 in the valve seat disk 12 by axial extending fuel supply passages 41 extending through the enlarged stem end 32 radially outward of compressible stem portion 34. To insure fluid fuel communication between the passages 18 and the supply passages 41, the bottom of the valve seat disk 12 can be recessed to provide an interconnecting fuel chamber, it may be formed in the free or upper end of the enlarged stem end 32 of the valve 11 or preferably, as shown, an interconnecting fuel chamber 42 is provided by the portion of the threaded bore 22 of the nozzle body 10 above the enlarged stem end 32 of the valve 11 that is recessed below the upper surface of the inlet end 10*a* of the nozzle body in the assembled position of valve 11 therein. To effect this, it is apparent that the normal longitudinal length of the valve 11 should be such that its enlarged stem end 32 is at least slightly recessed beneath the upper outer surface of the nozzle body 10 when the valve is assembled thereto.

The compressible stem portion 34 of the compressible valve 11 has the tubular wall thereof formed with a predetermined reduced wall thickness and the valve is formed of a suitable elastic material whereby its compressible stem portion can be deformed a limited amount, without permanent deformation, in an axial direction whereby its effective length can be reduced when fuel at a predetermined opening pressure $P_o$ is in the fuel chamber 40 to act on the differential area of the compressible valve 11 so as to effect compression of this valve in an axial or longitudinal direction to thereby effect opening movement of the valve head 30 relative to the valve seat 24 in the nozzle body 10. Opening or unseating of the valve relative to the valve seat will place the fuel chamber 40 in direct fluid communication with the fuel discharge passage means in the spray tip 21 so that fuel under pressure can be discharged from the nozzle assembly through the spray orifice 26. When the fuel pressure in the fuel chamber 40 is reduced or decreased to a predetermined closing pressure $P_c$, this compressible stem portion 34 can then expand to its as assembled, normal length in the nozzle body 10 whereby to again effect seating of the valve head 30 against the valve seat 24 in the nozzle body.

Referring now to FIG. 2, there is illustrated an embodiment of the subject fuel injection nozzle with compressible valve similar to that shown in FIG. 1 which is incorporated into a fuel injection nozzle, per se, which could be used as part of a fuel injection pump and nozzle system for an internal combustion engine, the fuel injection pump being used to supply fuel, at high pressure, intermittently to a plurality of such nozzles. As is well known, in such a system, the fuel injection pump would be physically separated from the nozzles but would be connected to each of the nozzles by suitable conduit means. For this purpose, the fuel injection nozzle assembly, shown in FIG. 2, includes a nozzle body means including a nozzle holder 50 and a nozzle body 10' clamped together by a sleeve nut 51 threaded onto the lower threaded portion 50*a* of the nozzle holder. The nozzle body 10' is formed with an enlarged upper or inlet end 10'*a* to provide a shoulder 10'*b* which seats on a shoulder 51*a* provided by the stepped bore through the sleeve nut 51.

The nozzle holder 50 is provided with a fuel passage means therethrough as formed by a stepped bore 53 and, at its upper end, the nozzle holder 50 is provided with external threads 50*b* whereby the fuel passage means provided by the bore 53 can be placed in fluid communication via a suitable fuel supply conduit, not shown, to a fuel injection pump, not shown, in a known manner. The stepped bore 53 in the nozzle holder provides a fuel passage therein that terminates in an enlarged fuel chamber cavity 54 that is partly closed at the bottom end of the nozzle holder by the upper surface of the inlet end 10'*a* of the nozzle body 10' and by a portion of the compressible valve 11 associated therewith.

The nozzle body 10', similar in construction to the nozzle body 10 previously described, includes a large diameter upper cylindrical inlet end 10'*a* with an intermediate portion 20' of reduced outside diameter depending therefrom, the intermediate portion 20' terminating at a lower spray tip 21' end. The nozzle body 10' is also formed with an internally threaded bore 22' extending from its inlet end 10'*a*, this bore being aligned with a bore cavity extending through the intermediate portion 20' providing this intermediate portion with an inner peripheral wall 23' and, the spray tip 21' is formed with a conical valve seat 24' extending radially inward from the annular wall 23' and it is provided with a bore passage 25' extending from and concentric with the valve seat 24' with this bore passage 25' being in communication with at least one discharge orifice 26' through the free end of the spray tip.

A compressible valve 11, as previously described, is positioned in the nozzle body 10' with the threads 33 at its upper enlarged shank end in threaded engagement with the internal threads 22' of the nozzle body 10' so that the head 30 of this compressible valve 11 is normally positioned in loaded abutment against the valve seat 24'. Like the fuel injection nozzle with compressible valve assembly described with reference to FIG. 1, the stem and a portion of the compressible valve 11 forms with the annular wall 23' of the nozzle body an annular fuel chamber 40' that is in communication, as controlled by the head 30 of valve 11 with the fuel bore passage 25' in the spray tip 21'.

For a better understanding of the invention, the dimensional details of a particular construction of a fuel injection nozzle with compressible valve, for example, as shown in FIG. 2, is described hereinafter. The compressible valve 11 of this assembly is made of a material having a modulus of elasticity (Young's modulus) E of $30 \times 10^6$ psi. The compressible stem portion 34 of the valve 11 was formed with an inside diameter $D_3$ of 0.1497 inch and the outside diameter $D_1$ of this stem portion was 0.1662 inch. With these internal and external diameters of the stem portion, the cross-sectional area of the thin tubular wall of this compressible stem portion 34 was 0.0041 square inches. The valve head 30 had an outside diameter $D_2$ of 0.0955 inch and thus, with the outside diameter $D_3$ of 0.1497 inch for the compressible stem portion of this valve, the differential area of this valve 11 acted on by the pressure of fuel in the annular fuel chamber 40' was 0.0145 square inches. The effective length L of the compressible stem portion 34 of the valve 11 was 1.4 inch and the effective preload $F_p$ on the valve whereby the valve head 30 is in preloaded abutment against the valve seat 24' was 43.5 pounds so that the column stress on the valve with this preload was 10,610 psi.

With this arrangement, the effective opening pressure $P_o$ of the valve, that is the pressure of which fuel within the fuel chamber 40' would effect compression of the valve whereby to cause a reduction in the longitudinal length of the valve to effect unseating of the valve head 30 from the valve seat 24', was 3,000 psi. At a typical injection pressure P of 10,000 psi, the column stress on the valve was 52,927 psi causing the valve head at this pressure to travel a distance of 0.002 inch relative to the valve seat 24' in a valve opening direction, that is, the normal longitudinal length of the valve was reduced by 0.002 inch. The closing pressure $P_c$ in this construction was 2,005 psi, so that when the pressure of fuel in the chamber 40' decreases to this pressure $P_c$, as a result of the injection of fuel therefrom, the stem of the valve 11 and, in particular, the compressible stem portion 34 thereof would expand back to its original longitudinal length to again effect seating of the head 30 against the valve seat 24'.

It will be apparent that the above pressures acting on the material from which the valve 11 has been fabricated will apply a maximum stress load thereon which is substantially below the modulus of elasticity for that material and, thus, the stress loads applied thereon are well within the elastic limit of the material from which the valve has been fabricated so that no permanent deformation of this element will occur.

It will be apparent from the above that the compressible valve 11 should be made of a selected elastic material having a suitable modulus of elasticity whereby the material used to fabricate the valve will permit limited compressing of the valve in a longitudinal direction while still permitting the valve to return to its original longitudinal extent or dimension after the removal of a predetermined stress load thereon.

It will also be apparent that a rigid connection be effected between the upper end of the compressible valve and the nozzle body in which it is mounted so that all longitudinal compression thereon will occur in one direction only whereby to effect unseating of the valve head 30 relative to its seat in the nozzle body.

It should also be apparent to those skilled in the art that, in the above described fuel injection nozzle with compressible valve of the invention, the non-stretching element, that is, the nozzle body of this nozzle assembly, would be constructed so that its longitudinal dimension does not change to any appreciable extent under the pressure of fuel therein encountered during the operation of this type nozzle assembly.

Although not shown, since it forms no part of the subject invention, it should be realized that a suitable heat transfer material or device could be incorporated into the hollow portion of the stem of the compressible valve 11, before the plug 37 is fixed to the stem, so that heat could be drawn from the hottest part of the valve, that is the valve head end, and then transferred to the cooler end of the stem, that is the end fixed to the nozzle assembly, such heat transfer materials or devices being well known in the prior valve art, especially in the prior art relating to exhaust valves for use in internal combustion engines.

What is claimed is:

1. A nozzle body with compressible valve assembly for use in a fuel injector nozzle assembly, said nozzle body with compressible valve assembly including a nozzle body having an inlet body portion at one end and a spray tip at its opposite end, said spray tip having fuel outlet means therein, said nozzle body further having a bore extending from said inlet end providing an annular valve seat in said spray tip in fluid communication with said fuel outlet means therein and, a compressible valve positioned in said nozzle body with said compressible valve having a reduced diameter valve head at one end thereof with an enlarged diameter stem extending therefrom, said stem including a tubular compressible stem portion connected to said valve head by an annular radial shoulder, said stem at its opposite end having an enlarged diameter stem end adjustably fixed to said nozzle body against axial movement in either direction and in position in said bore so that said valve head is in loaded abutment against said valve seat, said compressible valve forming with the internal wall provided by said bore in said nozzle body an annular fuel chamber, longitudinally extending fuel passage means in said enlarged stem end in communication at one end with said annular fuel chamber and connectable at its other end with an intermittently supplied source of fuel at high pressure, said tubular compressible stem portion being of substantially uniform diameter and having an annular wall of predetermined thickness for a predetermined longitudinal length whereby when fuel at a predetermined high fuel pressure is in said annular fuel chamber, said wall of said tubular compressible stem portion will be compressed radially so as to effect an axial reduction of the normal length of said compressible valve whereby said valve head is moved to an open position relative to said valve seat and when fuel at a reduced pressure below a predetermined low pressure is in said annular fuel chamber, said tubular compressible stem portion of said compressible valve will expand back to its normal longitudinal length whereby said valve head is positioned in abutment against said valve seat.

2. A fuel injector nozzle assembly including a nozzle body having a spray tip at one end thereof with a spray orifice therein, said nozzle body having a stepped bore extending from said one end of said spray tip to define in sequence a small diameter fuel passage in communication with the spray orifices at one end of the spray tip and an enlarged diameter chamber cavity, said stepped bore providing a radial shoulder concentric with and encircling said fuel passage whereby to provide a valve seat, a valve positioned in said stepped bore in said nozzle body, said valve having a reduced diameter valve head with an enlarged diameter stem extending therefrom, said valve having a seat formed complementary to said valve seat, the end of said valve stem opposite said valve head being adjustably fixed to said nozzle body to prevent axial movement of said one end of said valve stem relative to said nozzle body, to partly enclose one end of said chamber cavity and to position said seat of said valve head in abutment against said valve seat whereby the opposite end of said chamber cavity is normally closed, said enlarged diameter stem of said valve including an intermediate compressible stem portion of thin wall straight tubular configuration and of substantially uniform cross section connected by an annular shoulder to said valve head and positioned to extend through said chamber cavity to provide therein an annular fuel chamber therein, said compressible intermediate stem portion being of a predetermined longitudinal length and of predetermined substantially uniform outside diameter with the thickness of said thin wall thereof being such that fuel, when at a predetermined high fuel pressure, is in said annular fuel chamber, it can act on said compressible stem portion to cause it to compress radially whereby to effect an axial reduction of the normal length of said valve whereby to cause unseating of said valve head from said valve seat and when fuel at a predetermined low fuel pressure is in said fuel chamber, said intermediate stem portion can extend to its normal longitudinal length to effect seating of said valve head against said valve seat.

3. A fuel injector nozzle assembly including a nozzle body means that includes a nozzle body with an exposed spray tip at one end thereof through which fuel is discharged, said nozzle body means having fuel passage means therein including an enlarged chamber connectable to a source of high pressure fuel and partly closed at one end by the opposite end of said nozzle body from said spray tip, said nozzle body including a bored passage means therethrough and providing in said spray tip an annular valve seat and, a compressible valve positioned in said nozzle body, said compressible valve having a valve head of predetermined diameter at one end thereof with a valve stem of an outside diameter larger than the diameter of said valve head extending therefrom, said valve stem including a compressible stem portion having an annular wall of substantially uniform cross section and of predetermined thickness for a predetermined longitudinal extent, said compressible stem portion being next adjacent said valve head and connected thereto by an annular radial shoulder, the opposite end of said valve stem including a rigid enlarged diameter stem end portion fixed to said nozzle body against axial movement and axially positioned within said bored passage whereby said valve head is normally positioned in abutment against said valve seat, said compressible valve forming with said bored passage means in said nozzle body an annular fuel chamber closable at one end by said valve head seated against said valve seat, fuel supply means associated with said compressible valve and with said nozzle body in communication at one end with said annular fuel chamber and at its opposite end with said enlarged chamber of said nozzle body means, said compressible valve being acted on by fuel above a predetermined pressure in said annular fuel chamber whereby said compressible stem portion is compressed radially whereby the normal longitudinal length of said compressible valve is decreased to effect unseating of said valve head relative to said valve seat and, when fuel below a predetermined pressure is in said annular fuel chamber, said compressible valve will extend to its normal longitudinal extent whereby said valve head is seated against said valve seat.

4. A fuel injector nozzle assembly including a nozzle body means having a nozzle body with an exposed spray tip at one end thereof through which fuel is discharged, said nozzle body means having a fuel passage means therein including an enlarged chamber connectable to a source of high pressure fuel, said enlarged chamber being partly closed at one end by the opposite end of said nozzle body from said spray tip, said nozzle body including bored passage means extending from said opposite end providing an annular valve seat at said spray tip and an internal annular wall means extending longitudinally therefrom and, a compressible valve positioned in said bored passage means in said nozzle body, said compressible valve including a valve head at one end thereof with a stem extending therefrom that includes a thin wall, straight tubular compressible stem portion of substantially uniform diameter, the outside diameter of said compressible stem portion being greater than the outside diameter of said valve head next adjacent to said valve head, said compressible stem portion at its opposite end being interconnected to a further enlarged diameter stem end, said enlarged diameter stem being adjustably fixed to said opposite end of said nozzle body in a fixed axial position so that said valve head is in a predetermined loaded abutment against said valve seat, said compressible valve forming with said annular wall means of said nozzle body an annular fuel chamber, fuel delivery passage means in said nozzle body and in said stem end in communication at one end with said chamber and at its opposite end with said annular fuel chamber, said thin wall of said compressible stem portion being of a predetermined limited thickness for a predetermined longitudinal length so that an increase in fuel pressure will radially compress said thin wall whereby the normal longitudinal length of said compressible stem portion is decreased when fuel at and above a predetermined pressure is in said annular fuel chamber thereby effecting unseating of said valve head from said valve seat to permit discharge of fuel from said annular fuel chamber out through said spray tip and, when fuel below a lower predetermined fuel pressure is in said annular fuel chamber, said compressible stem portion will extend to its normal longitudinal length to effect seating of said valve head against said valve seat.

5. In an injector nozzle assembly, a nozzle body with a spray tip, having fuel discharge passage means therein, at one end of said nozzle body, the nozzle body having a stepped bore extending from the opposite end of said nozzle from said spray tip to communicate with the fuel discharge passage means in said spray tip, said stepped bore providing at the spray tip an annular valve seat concentric with said stepped bore and with one end of said fuel discharge passage means, a valve having a valve head at one end thereof and an enlarged diameter stem extending therefrom, said valve being positioned to extend through said stepped bore in said nozzle body with said valve head normally positioned in predetermined loaded abutment against said valve seat, the end of said stem opposite said valve head being rigidly fixed to said opposite end of said nozzle body against axial movement relative to said nozzle body, said valve forming with an annular inner wall in said nozzle body as provided by said stepped bore an annular fuel chamber in communication at one end with said fuel discharge passage means in said spray tip as controlled by said valve head, fuel inlet passage means associated with said valve and with said nozzle body in communication at one end with said annular fuel chamber and connectable at its other end to a source of pressurized fuel, said stem of said valve including a thin wall, tubular, compressible stem portion of substantially uniform diameter next adjacent to said valve head and extending a predetermined longitudinal distance therefrom, said thin wall of said tubular compressible stem portion being of a predetermined limited thickness whereby when fuel above a predetermined pressure is in said annular fuel chamber, it will radially compress said wall of said compressible stem portion whereby to effect an axial reduction of the normal effective longitudinal length of said stem thereby causing said valve head to move in an opening direction relative to said valve seat and, when fuel below a predetermined pressure is in said annular fuel chamber, said stem will extend to its normal longitudinal length to seat said valve head against said valve seat.

* * * * *